US010082339B2

(12) United States Patent
Huang

(10) Patent No.: US 10,082,339 B2
(45) Date of Patent: Sep. 25, 2018

(54) HEAT SINK ASSEMBLY

(71) Applicant: Tsung-Hsien Huang, I-Lan Hsien (TW)

(72) Inventor: Tsung-Hsien Huang, I-Lan Hsien (TW)

( * ) Notice: Subject to any disclaimer, the term of this patent is extended or adjusted under 35 U.S.C. 154(b) by 0 days.

(21) Appl. No.: 15/706,766

(22) Filed: Sep. 18, 2017

(65) Prior Publication Data

US 2018/0017336 A1 Jan. 18, 2018

Related U.S. Application Data

(62) Division of application No. 14/988,510, filed on Jan. 5, 2016, now Pat. No. 9,797,660.

(30) Foreign Application Priority Data

Oct. 9, 2015 (CN) ..... 2015 1 0650595

(51) Int. Cl.
*F28D 15/02* (2006.01)

(52) U.S. Cl.
CPC ..... *F28D 15/0275* (2013.01)

(58) Field of Classification Search
CPC ..... H01L 23/427; H01L 2924/0002; F28D 15/0275; F28D 15/0233
See application file for complete search history.

(56) References Cited

U.S. PATENT DOCUMENTS

| | | | | |
|---|---|---|---|---|
| 2005/0103474 | A1* | 5/2005 | Lee | F28F 1/32 165/104.33 |
| 2006/0203451 | A1 | 9/2006 | Wei et al. | |
| 2007/0000646 | A1 | 1/2007 | Chen et al. | |
| 2007/0074857 | A1 | 4/2007 | Xia et al. | |
| 2007/0284084 | A1 | 12/2007 | Lin | |
| 2009/0154103 | A1 | 6/2009 | Liu | |
| 2010/0319880 | A1 | 12/2010 | Yu et al. | |
| 2014/0138074 | A1 | 5/2014 | Huang | |

* cited by examiner

*Primary Examiner* — Tho V Duong
(74) *Attorney, Agent, or Firm* — Pai Patent & Trademark Law Firm; Chao-Chang David Pai

(57) ABSTRACT

A heat sink assembly includes a base block having a straight mounting groove on the middle and two U-shaped mounting grooves at two opposite lateral sides, cooling fins installed in the top wall of the base block, each cooling fin having multiple tight-fit mounting holes, a U-shaped heat pipe having a lower segment peripherally press-fitted into the straight mounting groove in flush with the bottom wall of the base block and an upper segment tightly inserted into one respective tight-fit mounting hole of each cooling fin, and two symmetrical, curved heat pipes with respective U-shaped lower segments thereof respectively and peripherally press-fitted into the U-shaped mounting grooves in flush with the bottom wall of the base block and respective upper segments thereof tightly inserted into respective tight-fit mounting holes of each cooling fin. Thus, heat can be drawn upwards from a heat source and evenly distributed through the cooling fins.

4 Claims, 9 Drawing Sheets

HEAT SINK ASSEMBLY

CROSS REFERENCE TO RELATED APPLICATIONS

This application is a division of pending U.S. patent application Ser. No. 14/988,510 filed Jan. 5, 2016, which claims the priority benefit of China Application No. 201510650595.X filed Oct. 9, 2015. The entirety of each of said Applications is incorporated herein by reference.

BACKGROUND OF THE INVENTION

(a) Field of the Invention

The present invention relates to heat sink technology, and more particularly to a heat sink assembly, which draws heat upwards and then evenly distributes heat to middle and lateral areas of the cooling fins thereof for quick dissipation.

(b) Description of the Prior Art

Conventional heat sinks generally comprise a plurality of cooling fins, a base block and at least one heat pipe. Exemplars are seen in Taiwan Patents Number I260962; I359254. According to these prior art designs, each heat pipe has one end inserted into the bottom side of the base block and an opposite end coupled to the group of cooling fins. In these designs, two or three heat pipes are mounted in a middle part of the base block in a parallel manner and coupled to a middle part of the group of cooling fins. Because heat transfer path is limited to the middle part of the base block and the middle part of the group of cooling fins, these designs cannot achieve comprehensive heat absorbing and dissipating effects. Therefore, the heat dissipation efficiency of the prior aet designs is low.

Further, in the designs of Taiwan Patent Numbers I428552; M337230; M354103, curved heat pipes are mounted in between a base block and a group of cooling fins. These designs need to employ a solder bonding technique to bond the curved heat pipes, the base block and the group of cooling fins together, and therefore these designs do not comply with environmental safety requirements. Further, because the heat pipes are not exposed to the outside for direct contact with the heat source component, the heat pipes can simply transfer heat indirectly, thus lowering the overall heat dissipation efficiency.

SUMMARY OF THE INVENTION

The present invention has been accomplished under the circumstances in view. It is therefore the main object of the present invention to provide a heat sink assembly, which comprises a base block, a plurality of cooling fins and at least three heat pipes. The base block comprises opposing top and bottom walls, a straight mounting groove located at the bottom wall, and two U-shaped mounting grooves located at the bottom wall at two opposite lateral sides relative to the straight mounting groove. The cooling fins are respectively installed in the top wall of the base block, each comprising a plurality of tight-fit mounting holes. The three heat pipes include one U-shaped heat pipe and two symmetrical, curved heat pipes. The U-shaped heat pipe comprises an upper segment inserted through one respective tight-fit mounting hole of each cooling fin, a lower segment peripherally press-fitted into the straight mounting groove in flush with the bottom wall of the base block, and a middle segment connected between the upper segment and lower segment of the U-shaped heat pipe. The symmetrical, curved heat pipes each comprise an upper segment inserted through one respective tight-fit mounting hole of each cooling fin, a U-shaped lower segment peripherally press-fitted into one respective U-shaped mounting groove in flush with said bottom wall of said base block, and a middle segment connected between the upper segment and U-shaped lower segment of the respective symmetrical, curved heat pipe. Thus, the lower segments of the two symmetrical, curved heat pipes and the bottom wall of the base block can be directly attached to the surface of a heat source component, enabling heat to be drawn upwards from the heat source component and evenly distributed through the cooling fins for quick dissipation. Thus, the invention enables heat to be evenly distributed through the total area of the base block and the total area of each cooling fin without being limited to a specific local area, significantly enhancing the overall heat dissipation efficiency of the heat sink assembly.

It is another object of the present invention to provide a heat sink assembly, which comprises a base block having a straight mounting groove and two U-shaped mounting grooves located at a bottom wall with the two U-shaped mounting grooves disposed at two opposite lateral sides relative to the straight mounting groove, cooling fins installed in an opposing top wall of the base block, and three heat pipes with respective lower segments thereof respectively and peripherally press-fitted into the straight mounting groove and U-shaped mounting grooves in flush with the bottom wall of the base block and respective upper segments thereof tightly inserted through the cooling fins.

It is still another object of the present invention to provide a heat sink assembly, which comprises a base block having two straight mounting grooves and two U-shaped mounting grooves located at a bottom wall, cooling fins installed in an opposing top wall of the base block, two U-shaped heat pipes and two symmetrical, curved heat pipes with respective lower segments thereof respectively and peripherally press-fitted into the straight mounting grooves and U-shaped mounting grooves in flush with the bottom wall of the base block and respective upper segments thereof tightly inserted through the cooling fins.

Other advantages and features of the present invention will be fully understood by reference to the following specification in conjunction with the accompanying drawings, in which like reference signs denote like components of structure.

DETAILED DESCRIPTION OF THE PREFERRED EMBODIMENTS

Referring to FIGS. 1-9, a heat sink assembly in accordance with a first embodiment of the present is shown. The heat sink assembly comprises a plurality of cooling fins 1, a base block 2 and at least three heat pipes 31,32,33 (see FIG. 8). The cooling fins 1 are installed in a top wall of the base block 2 (see FIGS. 1-3), each comprising a plurality of tight-fit mounting holes 11 for the mounting of the heat pipes 31,32,33.

Figure 9:
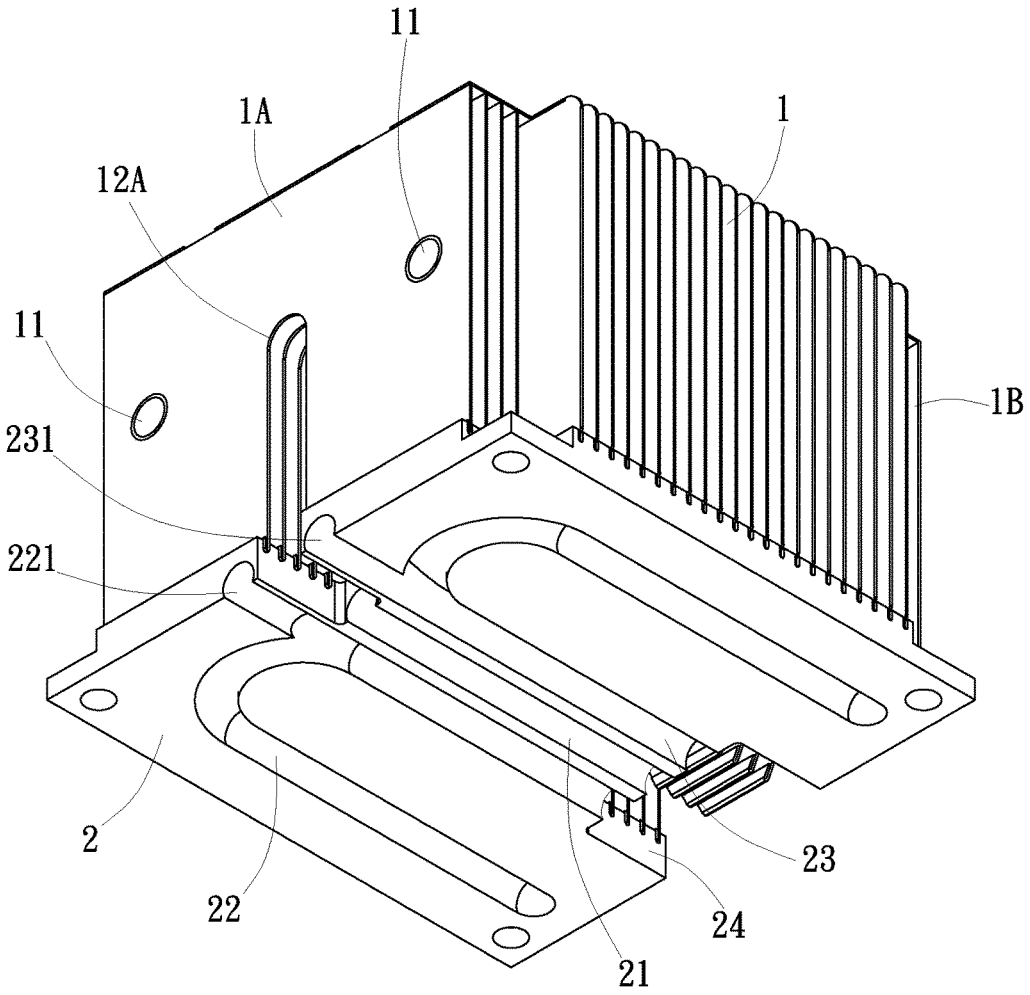
FIG. 9 is an oblique bottom elevation of the first embodiment of the present invention before installation of the heat pipes.
Figure 10:
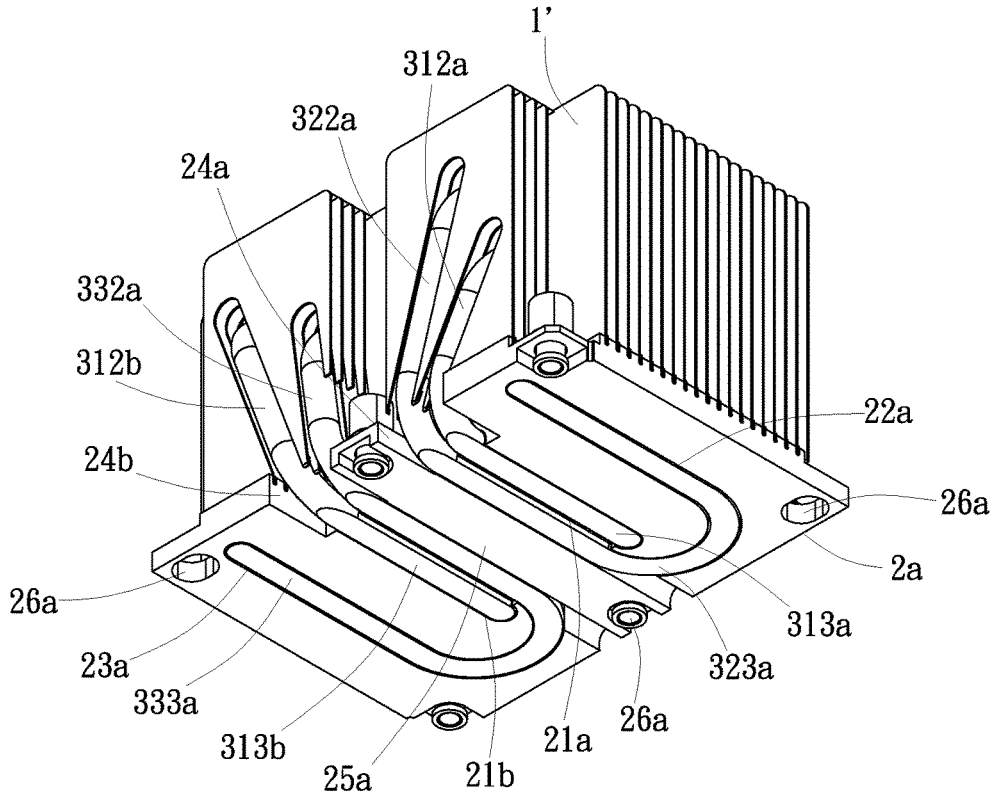
FIG. 10 is an oblique bottom elevational assembly view of a heat sink assembly in accordance with a second embodiment of the present invention.
Figure 11:
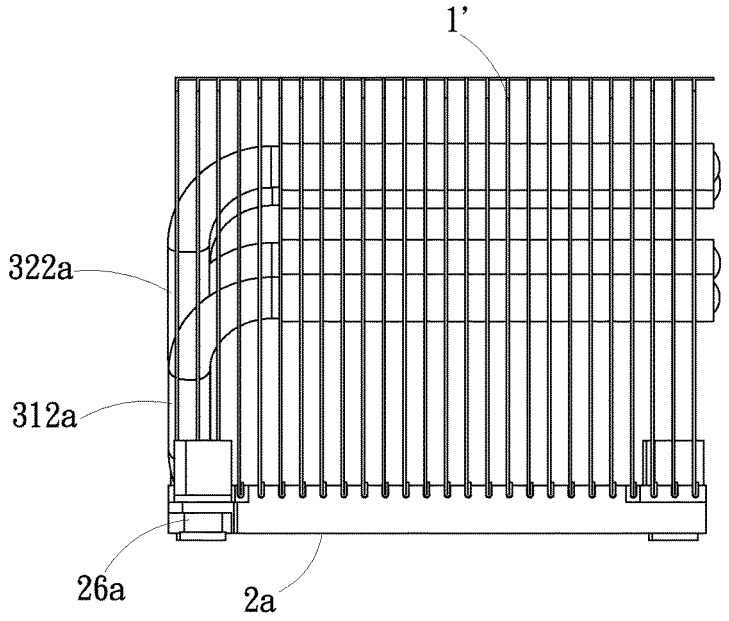
FIG. 11 is a side view of the heat sink assembly in accordance with a second embodiment of the present invention.
Figure 12:
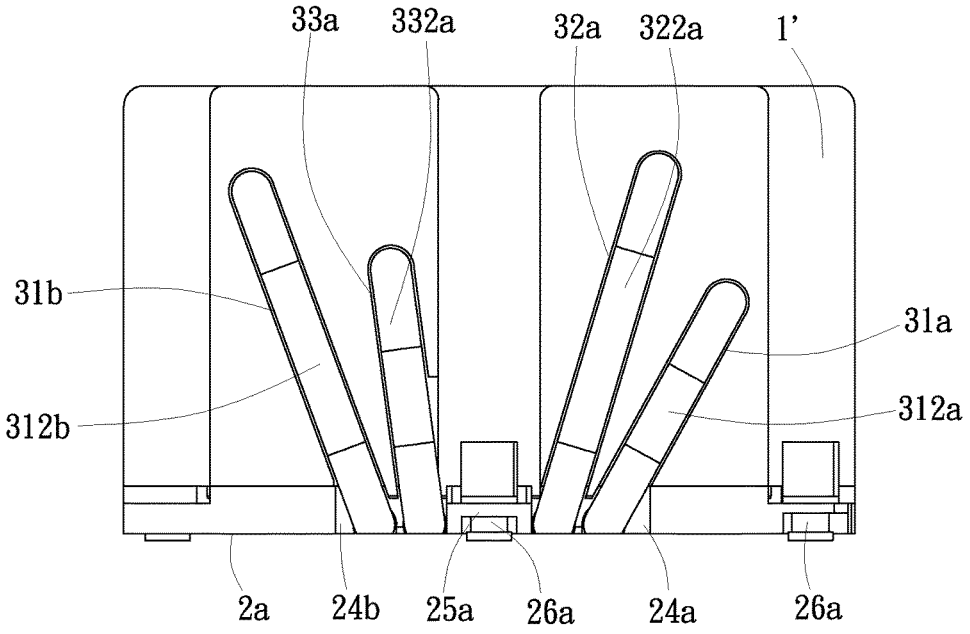
FIG. 12 is a front view of the heat sink assembly in accordance with a second embodiment of the present invention.
Figure 13:
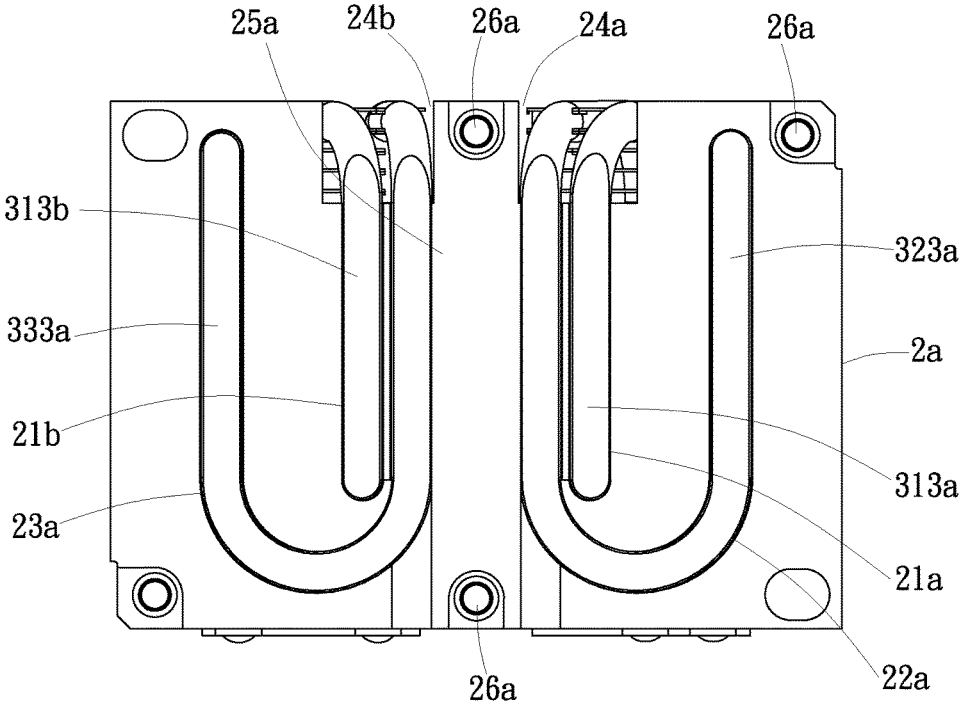
FIG. 13 is a bottom view of the heat sink assembly in accordance with a second embodiment of the present invention.

The base block 2, as illustrated in FIG. 9, comprises a straight mounting groove 21 located at a bottom wall thereof and two U-shaped mounting grooves 22,23 symmetrically disposed at two opposite lateral sides relative to the straight mounting groove 21. The straight mounting groove 21 can be located at the midpoint of the bottom wall of the base block 2. The U-shaped mounting grooves 22,23 can be respectively located at two opposite lateral sides of the bottom wall of the base block 2.

Figure 8:
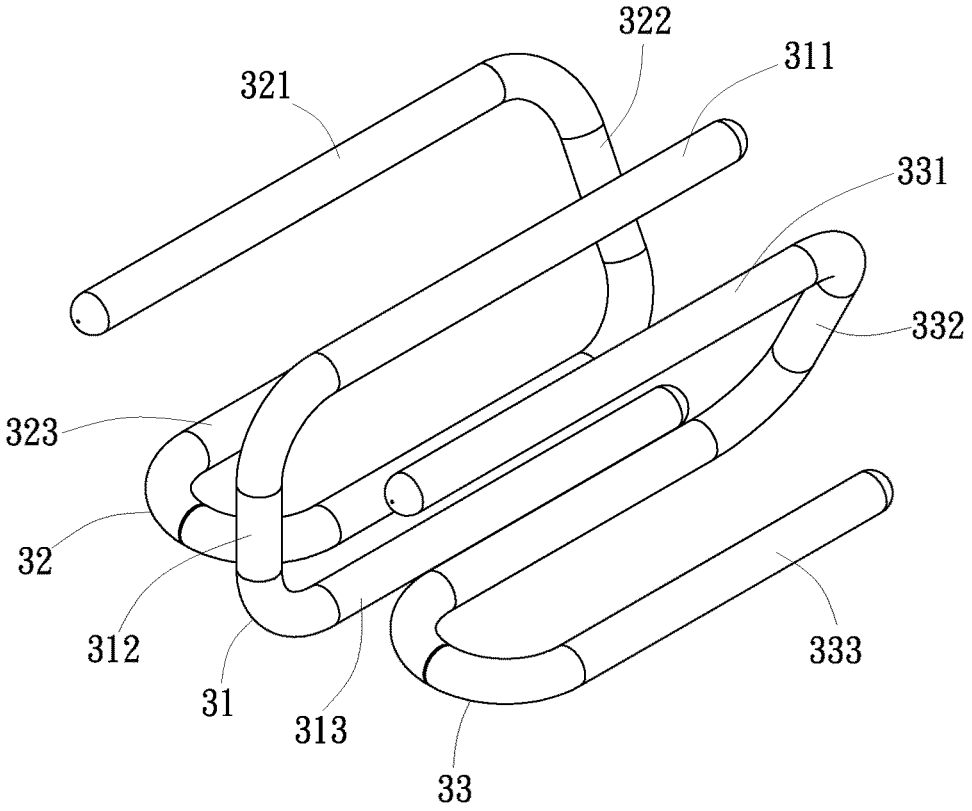
FIG. 8 illustrates the relative positions of the three heat pipes of the heat sink assembly in accordance with the first embodiment of the present invention before installation.

The three heat pipes 31,32,33, as illustrated in FIG. 8, include one U-shaped heat pipe 31 and two symmetrical, curved heat pipes 32,33. The U-shaped heat pipe 31 comprises a straight upper segment 311 inserted through one tight-fit mounting hole 11 of each cooling fin 1 (1A,1B), a straight lower segment 313 peripherally press-fitted into the straight mounting groove 21 of the base block 2, and a curved middle segment 312 connected between one end of the straight upper segment 311 and one end of the straight lower segment 313. The two symmetrical, curved heat pipes 32,33 each comprise a straight upper segment 321,331 inserted through one respective tight-fit mounting hole 11 of each cooling fin 1, a substantially U-shaped and horizontally extended lower segment 323,333 respectively peripherally press-fitted into the U-shaped mounting grooves 22,23 of the base block 2 in flush with the bottom wall of the base block 2 for bonding with the bottom wall of the base block 2 to a flat surface of a heat source component, and a middle segment 322,332 connected between one end of the straight upper segment 321,331 and one end of the U-shaped and horizontally extended lower segment 323,333. The U-shaped heat pipe 31 is capable of transferring heat from the attached heat source component to the middle area of the base block 2 and the middle area of each cooling fin 1. The two symmetrical, curved heat pipes 32,33 are capable of transferring heat from the attached heat source component to the two opposite lateral areas of the base block 2 and the two opposite lateral areas of each cooling fin 1. Thus, absorption and transfer of heat will not be excessively concentrated in the middle area of the base block 2 and the middle area of each cooling fin 1. Therefore, the invention enables heat to be evenly distributed through the total area of the base block 2 and the total area of each cooling fin 1 without being limited to a specific local area. As a result, the overall heat dissipation efficiency of the heat sink assembly is significantly enhanced.

Further, the upper segments 311,321,331 of the three heat pipes 31,32,33 are respectively inserted through the tight-fit mounting holes 11 of each cooling fin 1; the middle segments 322,332 of the two symmetrical, curved heat pipes 32,33 are obliquely and bilaterally attached to the cooling fins 1 in a symmetric manner (see FIG. 6) without bonding.

The U-shaped heat pipe 31 is disposed between the two symmetrical, curved heat pipes 32,33 with the upper segment 311 inserted through the cooling fins 1. Further, in this embodiment, these two symmetrical, curved heat pipes 32,33 are equally spaced from the U-shaped heat pipe 31.

In this embodiment, the U-shaped heat pipe 31 is inserted through the middle area of each cooling fin 1, the two symmetrical, curved heat pipes 32,33 are respectively inserted through the two opposite lateral areas of each cooling fin 1, and therefore, these three heat pipes 31,32,33 respectively extend through the middle and opposing lateral areas of the base block 2 and the middle and opposing lateral areas of each cooling fin 1 for drawing heat upwards and distributing heat evenly through cooling fins 1 for quick dissipation.

Figure 2:
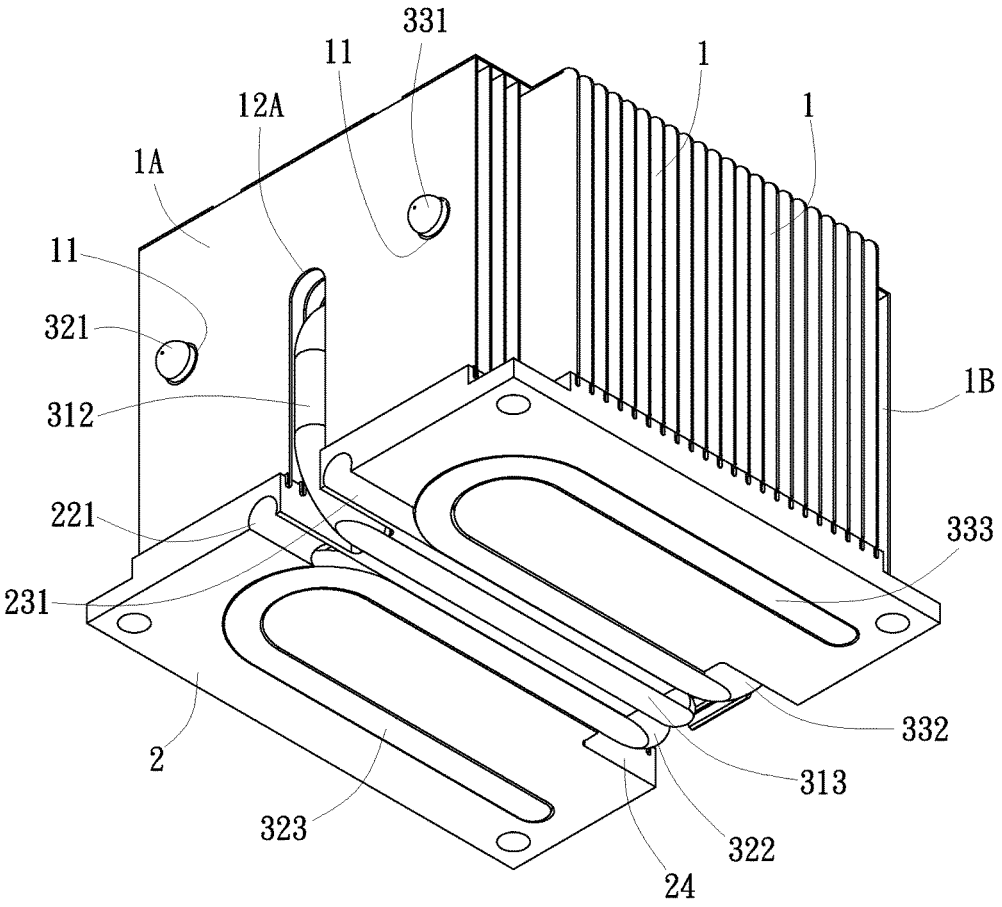
FIG. 2 is an oblique bottom elevational view of the heat sink assembly in accordance with the first embodiment of the present invention.
Figure 3:
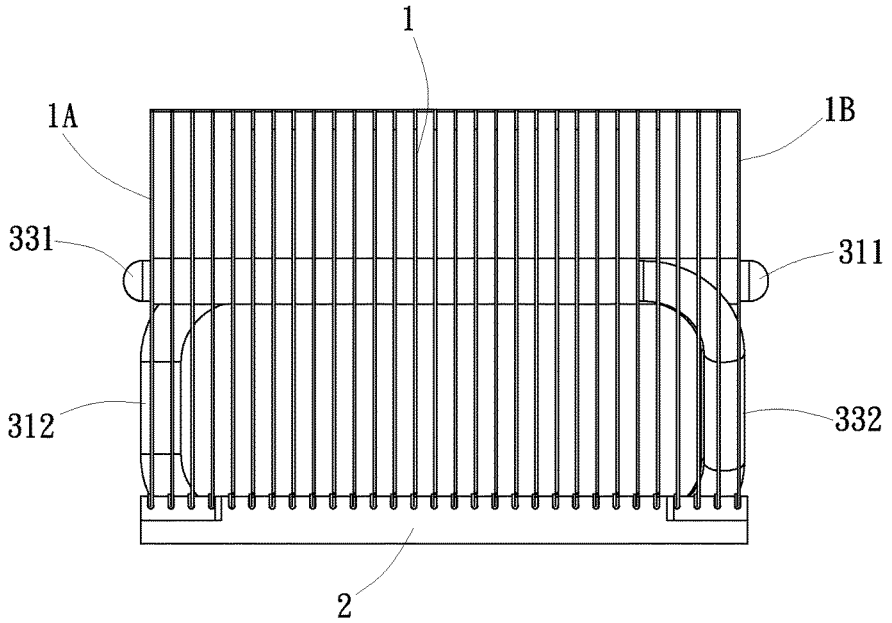
FIG. 3 is a side view of the heat sink assembly in accordance with the first embodiment of the present invention.
Figure 4:
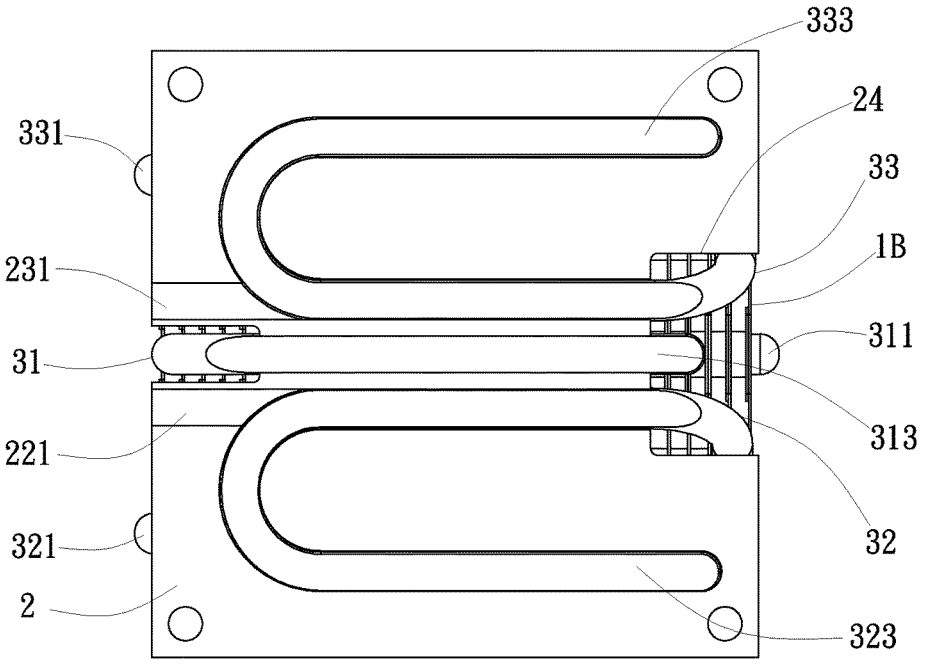
FIG. 4 is a bottom view of the heat sink assembly in accordance with the first embodiment of the present invention.
Figure 5:
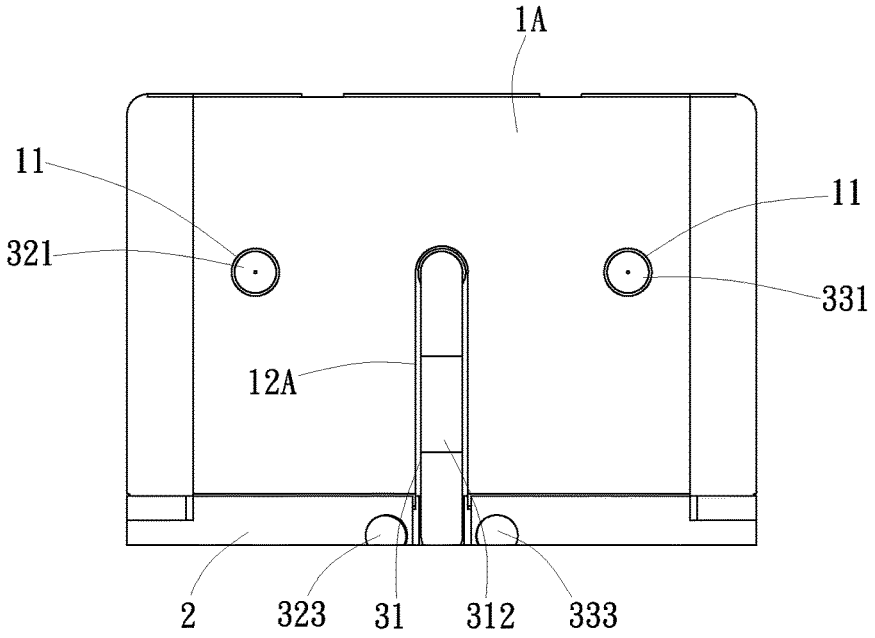
FIG. 5 is a schematic left side view of the heat sink assembly in accordance with the first embodiment of the present invention.

As illustrated in FIG. 2, the base block 2 further comprises a mating notch 24 for receiving curved connection areas between the lower segments 323,333 and middle segments 322,332 of the heat pipes 32,33, enabling these curved connection areas to be concealed in the base block 2 and well protected by the base block 2 against accidental impact.

Figure 1:
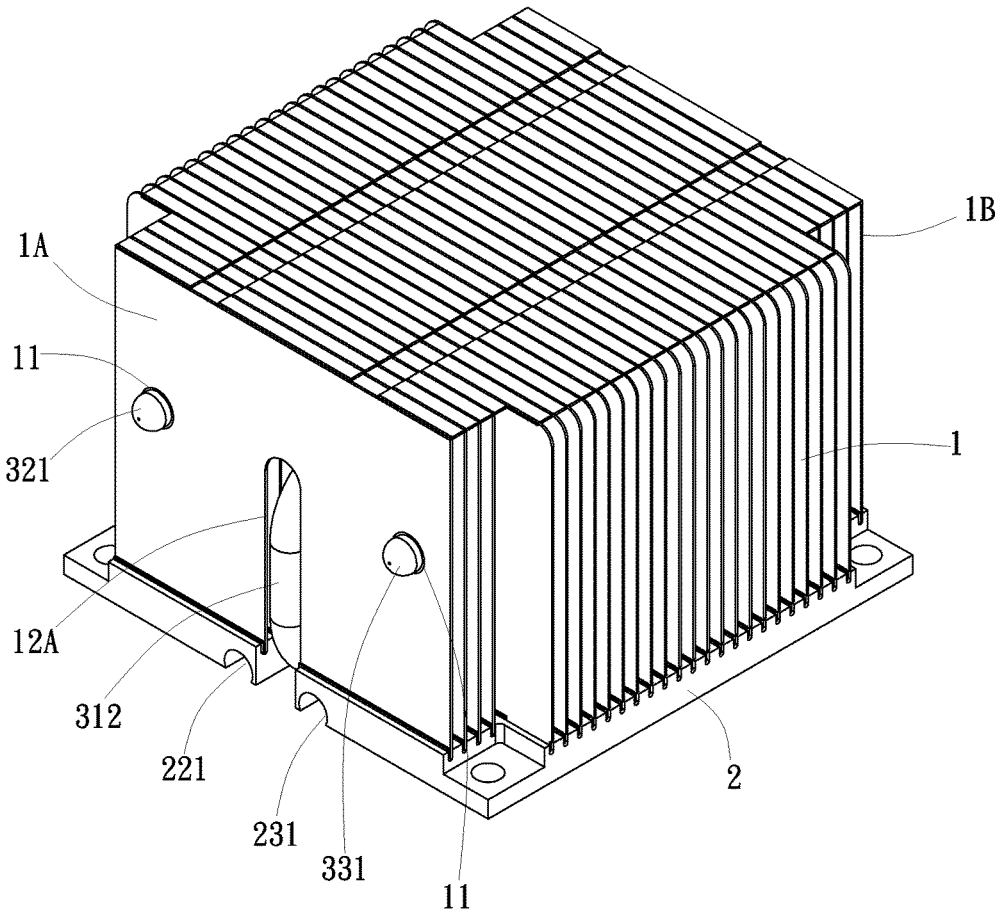
FIG. 1 is an oblique top elevational view of a heat sink assembly in accordance with a first embodiment of the present invention.

As illustrated in FIG. 1, one or multiple outer cooling fins 1A are bonded to the base block 2 at an outer side relative to the cooling fins 1. Each outer cooling fin 1A comprises a slot 12A (see FIG. 5) for accommodating the middle segment 312 of the U-shaped heat pipe 31 in a tight fit manner.

Figure 6:
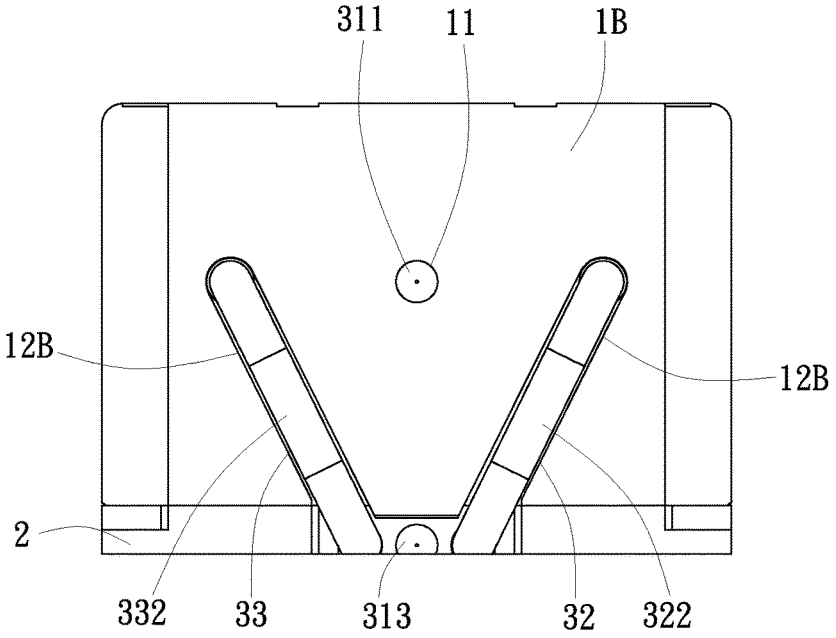
FIG. 6 is a schematic right side view of the heat sink assembly in accordance with the first embodiment of the present invention.
Figure 7:
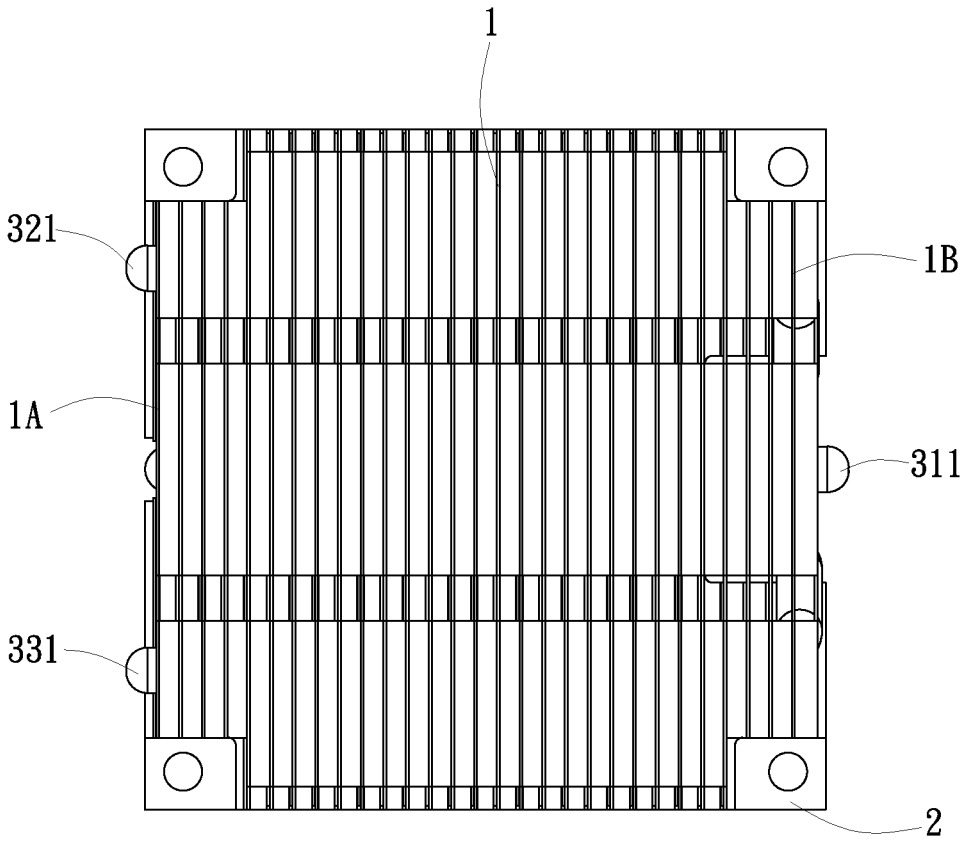
FIG. 7 is a schematic top view of the heat sink assembly in accordance with the first embodiment of the present invention.

Similarly, as shown in FIG. 6, one or multiple outer cooling fins 1B are bonded to the base block 2 at an opposite outer side relative to the cooling fins 1. Each outer cooling fin 1B comprises two slots 12B for accommodating the middle segments 322,332 of the symmetrical, curved heat pipes 32,33 in a tight fit manner.

Referring to FIG. 9, the base block 2 further comprises two machining grooves 221,231 located at the bottom wall thereof and respectively extended from one border edge thereof to the two U-shaped mounting grooves 22,23. The machining groove 221,231 is designed to facilitate machining of the U-shaped mounting grooves 22,23.

Referring to FIGS. 10-13, a heat sink assembly in accordance with a second embodiment of the present invention is shown. The heat sink assembly comprises a plurality of cooling fins 1', a base block 2*a* and four heat pipes 31*a*,31*b*, 32*a*,33*a*. The composition and structural details of the cooling fins 1' and the base block 2*a* are substantially similar to that of the aforesaid first embodiment with the exceptions as outlined hereinafter.

The base block 2*a* comprises two straight mounting grooves 21*a*,21*b* and two U-shaped mounting grooves 22*a*, 23*a* located at the bottom wall thereof. The lower segments 313*a*,313*b*,323*a*,333*a* of the four heat pipes 31*a*,31*b*,32*a*, 33*a* are respectively and peripherally fitted into the straight mounting grooves 21*a*,21*b* and U-shaped mounting grooves 22*a*,23*a* of the base block 2*a*. The base block 2*a* further comprises two mating notches 24*a*,24*b* for receiving the curved connection areas between the lower segments 313*a*, 313*b*,323*a*,333*a* of the heat pipes 31*a*,31*b*,32*a*,33*a* and the middle segments 312*a*,312*b*,322*a*,332*a* thereof, enabling these curved connection areas to be concealed in the base block 2*a* and well protected by the base block 2*a* against accidental impact.

The four heat pipes 31*a*,31*b*,32*a*,33*a* include two U-shaped heat pipes 31*a*,31*b* and two symmetrical, curved heat pipes 32*a*,33*a*. The lower segments 313*a*,313*b* of the U-shaped heat pipes 31*a*,31*b* are respectively disposed adjacent to the lower segments 323*a*,333*a* of the symmetrical, curved heat pipe 32*a*,33*a* (see FIG. 13).

In this second embodiment, the base block 2*a* further comprises a spacer portion 25*a* formed of a part of the bottom wall thereof between the two mating notches 24*a*, 24*b*, and a plurality of mounting through holes 26*a* respectively disposed at four corners thereof and opposing front and rear ends of the spacer portion 25*a* for fastening to a circuit board (not shown) by respective fastening members.

The mounting arrangement between the cooling fins 1,1' and the base block 2,2*a* is achieved using a tight fitting technique that is of the known art and not within the scope of the present invention, therefore, no further detailed description in this regard will be necessary.

In the heat sink assembly in accordance with the present invention, the cooling fins 1,1', the base block 2,2*a* and the three heat pipes 31,32,33 (or four heat pipes 31*a*,31*b*,32*a*, 33*a*) are respectively fastened together using a tight fitting technique, therefore, when thermal expansion occurs, the overall structural tightness will be enhanced, improving the heat dissipation efficiency. Further, the assembly process of the heat sink assembly in accordance with the present invention eliminates solder bonding or nickel electroplating, ensuring compliance with environmental standards.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A heat sink assembly, comprising a base block having opposing top and bottom walls, a plurality of cooling fins respectively installed in said top wall of said base block, each said cooling fin comprising a plurality of mounting holes, and at least four heat pipes tightly press-fitted into said mounting holes of said cooling fins, wherein:

said base block comprises two straight mounting grooves located at said bottom wall and two U-shaped mounting grooves located at said bottom wall at two opposite lateral sides relative to said straight mounting grooves;

said four heat pipes include two U-shaped heat pipes and two symmetrical, curved heat pipes, each said U-shaped heat pipe comprising an upper segment inserted through one respective said tight-fit mounting hole of each said cooling fin, a lower segment peripherally press-fitted into one respectively said straight mounting groove of said base block and a middle segment connected between the upper segment and the lower segment of the respective said U-shaped heat pipe, said symmetrical, curved heat pipes each comprising an upper segment inserted through one respective said tight-fit mounting hole of each said cooling fin, a U-shaped lower segment peripherally press-fitted into one respective said U-shaped mounting groove of said base block in flush with said bottom wall of said base block, and a middle segment connected between the upper segment and the U-shaped lower segment of the respective said symmetrical, curved heat pipe.

2. The heat sink assembly as claimed in claim 1, wherein said base block further comprises two mating notches adapted for receiving curved connection areas between the lower segments and middle segments of said four heat pipes.

3. The heat sink assembly as claimed in claim 2, wherein said base block further comprises a spacer portion formed of a part of said bottom wall and disposed between said two mating notches.

4. The heat sink assembly as claimed in claim 3, wherein said base block further comprises a plurality of mounting through holes respectively disposed in four corners thereof and opposing front and rear ends of said spacer portion.

* * * * *